US006682260B2

(12) United States Patent
Peltz

(10) Patent No.: US 6,682,260 B2
(45) Date of Patent: Jan. 27, 2004

(54) ROLLER COMPACTED CONCRETE PAVING SEALING METHOD

(76) Inventor: Ronald L. Peltz, A.G. Peltz Group, LLC, 926 Liberty Pack Loop, Birmingham, AL (US) 35242

( * ) Notice: Subject to any disclaimer, the term of this patent is extended or adjusted under 35 U.S.C. 154(b) by 10 days.

(21) Appl. No.: 10/158,866

(22) Filed: Jun. 3, 2002

(65) Prior Publication Data

US 2003/0223814 A1 Dec. 4, 2003

(51) Int. Cl.[7] ..... E01C 11/02
(52) U.S. Cl. ..... 404/74; 404/17; 404/47
(58) Field of Search ..... 404/89, 93, 103, 404/107, 74, 47, 94, 17

(56) References Cited

U.S. PATENT DOCUMENTS

| | | | | |
|---|---|---|---|---|
| 3,555,982 A | | 1/1971 | George | 94/18 |
| 3,629,986 A | | 12/1971 | Klittich | 52/396 |
| 3,712,188 A | | 1/1973 | Worson | 94/18 |
| 3,813,180 A | | 5/1974 | O'Brill | 404/48 |
| 3,942,294 A | | 3/1976 | Savell, Jr. | 52/259 |
| 4,023,324 A | | 5/1977 | Majeske | 52/396 |
| RE29,377 E | | 8/1977 | O'Brill | 404/48 |
| 4,287,696 A | | 9/1981 | Mullen | 52/309.7 |
| 4,659,252 A | | 4/1987 | Sexton et al. | 405/109 |
| 4,699,540 A | | 10/1987 | Gibbon et al. | 404/49 |
| 4,824,283 A | | 4/1989 | Belangie | 404/64 |
| 4,828,428 A | * | 5/1989 | Anderson | 404/102 |
| 4,927,291 A | | 5/1990 | Belangie | 404/64 |
| 5,088,854 A | * | 2/1992 | Sovik | 404/72 |
| 5,695,811 A | * | 12/1997 | Andersen et al. | 427/133 |
| 5,971,656 A | * | 10/1999 | Kitsmiller | 404/74 |
| 6,183,575 B1 | | 2/2001 | Embelton | 156/71 |
| 6,439,806 B1 | * | 8/2002 | Dillingham | 404/95 |

* cited by examiner

*Primary Examiner*—Thomas B. Will
*Assistant Examiner*—Raymond W Addie
(74) *Attorney, Agent, or Firm*—Richard C. Litman

(57) ABSTRACT

A roller compacted concrete paving sealing method which includes the steps of paving a first area with roller compacted concrete paving, paving a second area with roller compacted concrete paving adjacent to the first paved area, forming a cold joint between the first area and the second area, rolling the cold joint, allowing the rolled cold joint to cure, milling the cold joint and removing any milled material, applying primer to the milled cold joint, filling the milled joint with hot poured filler and finishing the filled joint. The method is done with asphalt paving equipment and specialty milling and hot poured filler equipment.

14 Claims, 5 Drawing Sheets

ROLLER COMPACTED CONCRETE PAVING SEALING METHOD

BACKGROUND OF THE INVENTION

1. Field of the Invention

The present invention relates to a method for sealing joints of roller compacted concrete paving surfaces.

2. Description of the Related Art

Construction materials have become increasingly more sophisticated and accommodating for many builders and contractors. Advances in construction processes have addressed many problems that older processes could not address. A lot of these advances have come from the advances in polymer chemistry and building materials. Advances in the methods and applications of these polymers and building materials are evident in the related art.

U.S. Pat. No. Re. 29,377 and U.S. Pat. No. 3,813,180 issued to O'Brill, outlines the use of a frangible package containing sealant for sealing joints between adjacent construction panels or slabs composed of materials such as concrete and other masonry products.

U.S. Pat. No. 3,555,982 issued to George, outlines the use of an expansion joint seal of the type commonly used in sealing adjacent deck panels of a bridge, although it could be used in any case where a seal for an expansion joint between two panels is required. The seal consists essentially of an elastomer strip with transversely extending holes adapted to receive load-bearing bars in sliding relation to each other so that as the panels expand and contract, the elastomer can follow the expansion and contraction and slide relative to the load-bearing bars.

U.S. Pat. No. 3,629,986 issued to Klittich, outlines an expansion joint assembly used between concrete slabs, which is a lower expansion joint strip that becomes permanently positioned between the concrete slabs and a removable topping strip that exposes a controlled depth groove above the expansion joint strip for receiving a sealant. In a modification, the upper edge of the expansion joint strip is coated with a material that will not bond or adhere to the sealant, permitting unrestricted lateral expansion and contraction of the sealant.

U.S. Pat. No. 3,712,188 issued to Worson, outlines an elongated sealing means for sealing a joint in a concrete slab or the like. The sealing means includes a pair of elongated, upwardly open channels which extend the complete depth of the seal and are located laterally inward of the outer side surfaces of the seal whereby the blades of a holding device can be inserted into the channels for laterally compressing the seal.

U.S. Pat. No. 4,023,324 issued to Majeske, outlines a method of making an expansion joint for roads and buildings which is suited for structures employing poured concrete slabs or precast concrete panels or slabs, the joint including a stabilized foam strip to both sides of which a slab or panel is assembled, the outer or upper face of the strip providing a gaging surface or face, the strip having a readily removable outer portion for application of caulking or sealant material after removal of the outer portion in the space provided.

U.S. Pat. No. 4,287,696 issued to Mullen, outlines the use of an expansible caulking material in strip form, and is suitable for use in sealing joints between vertical panels, and packing wide expansion joints occurring in parking decks, bridges, airport runways and the like, with a shortened expansion time, particularly for use in cold locations where the expansion would be unduly delayed.

U.S. Pat. No. 4,699,540 issued to Gibbon et al., outlines the use of an expansion joint for joining adjacent concrete sections separated by an expansion slot such as in a roadway having concrete sections and a slot there between. The joint includes a preformed longitudinal sealing element, which is formed from a resilient material and installed within the slot. An initially flowing adhesive material is applied between the sealing element and opposing side surfaces of the concrete sections making up the joint.

U.S. Pat. No. 4,659,252 issued to Sexton et al., outlines a dam structure for retaining water in a reservoir. A bonded impervious liner, such as polyvinyl chloride (PVC) sheeting, is provided on the downstream face of the precast concrete panel assembly. The liner includes individual membranes bonded to adjacent panels and heat welded impervious strips are provided along the joints between the panels. A poured concrete curtain wall is provided adjacent to the liner of the precast concrete panel assembly. Roller compacted concrete is then provided in layers on the downstream side of the poured concrete curtain wall.

U.S. Pat. No. 4,824,283 and U.S. Pat. No. 4,927,291 issued to Belangie, outlines the use of a sealed joint in a concrete highway or the like installed in a channel formed above the usual shrinkage control cut between adjoining concrete slabs by depositing a mass of uncured ductile and elastic adhesive, preferably a special silicone material, in such a channel and embedding a preformed length of a cured ductile and elastic material, again preferably a special silicone material, in such adhesive.

U.S. Pat. No. 6,183,575 issued to Embelton, outlines a method and strip for sealing between opposed surfaces and the formation of a sealable groove in a body of set material. The method of sealing utilizes a sealing strip which is introduced between the surfaces and the set material, which is provided between the sealing strip and one of the surfaces.

Although each of these patents outline a useful method or construction procedure, only the Sexton et al. patent involves roller compacted concrete paving, which is an increasingly popular construction procedure. The construction procedure in the Sexton et al. patent pertains only to roller compacted concrete paving involving the construction of a dam. Unfortunately, roller compacted concrete paving is prone to a deterioration of the joints between slabs known as spalling. Addressing this problem, could be very valuable to those people who have utilized compacted concrete paving in anticipation of the eventual spalling problem.

None of the above inventions and patents, taken either singularly or in combination, is seen to describe the instant invention as claimed. Thus a roller compacted concrete paving sealing method solving the aforementioned problems is desired.

SUMMARY OF THE INVENTION

The invention is a roller compacted concrete paving sealing method which includes the steps of paving a first area with roller compacted concrete paving, paving a second area with roller compacted concrete paving adjacent to the first paved area, forming a cold joint between the first area and the second area, rolling the cold joint, allowing the rolled cold joint to cure, milling the cold joint and removing any milled material, applying primer to the milled cold joint, filling the milled joint with hot poured filler and finishing the filled joint. The method is done with asphalt paving equipment and specialty milling and hot poured filler application equipment.

Accordingly, it is a principal object of the invention to provide a method that will prevent spalling in the joints of roller compacted concrete surfaces.

It is another object of the invention to provide protection against moisture penetration in the joints of roller compacted concrete surfaces.

It is a further object of the invention to provide a material that will expand and contract with the concrete used in the joints of roller compacted concrete surfaces.

Still another object of the invention is to allow for unlimited time to elapse between the placement of the areas forming a joint.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
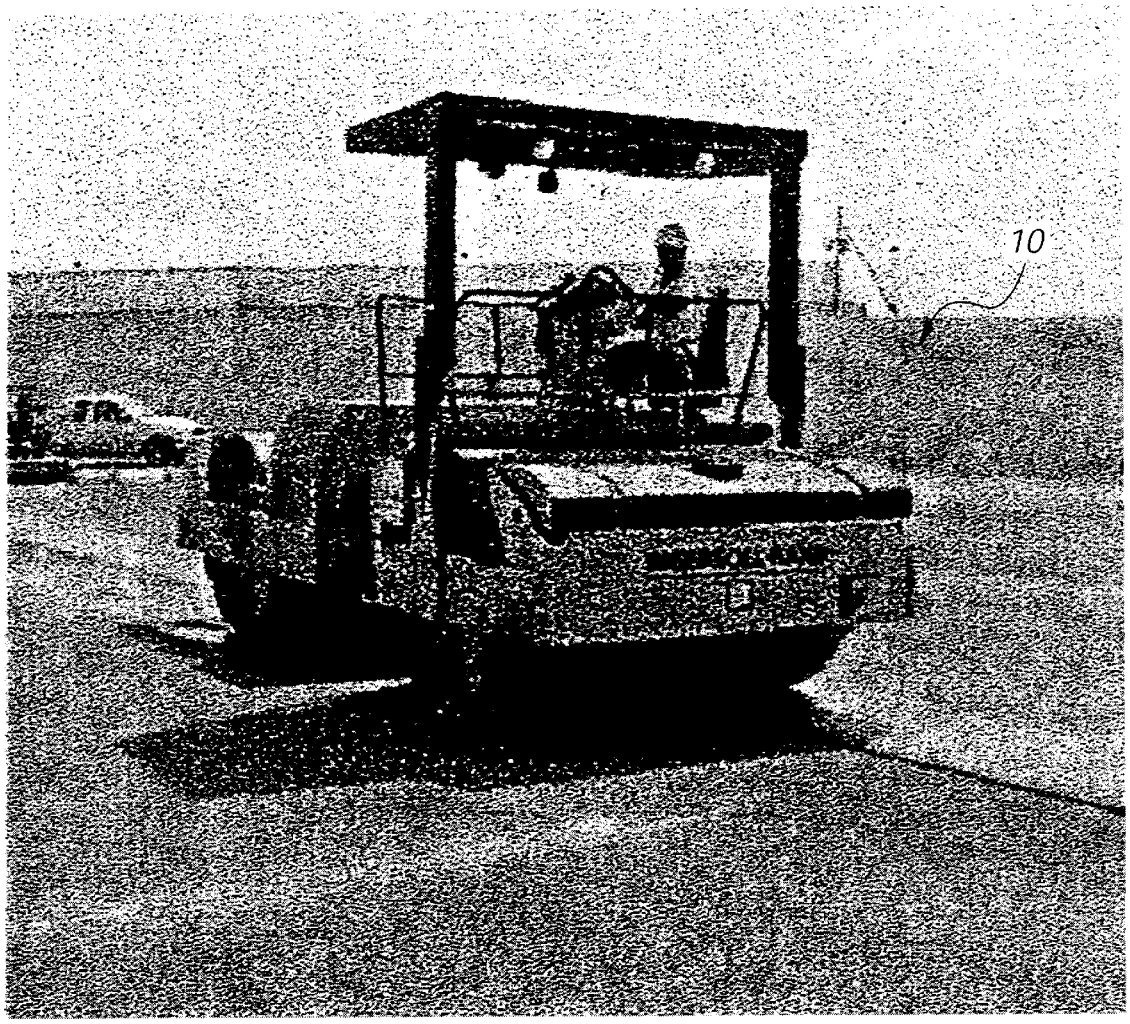
FIG. 1 is an environmental, perspective view of a roller compacted concrete paving sealing method according to the present invention.

The present invention is a Roller Compacted Concrete (RCC) paving sealing method 10 comprising the steps of paving a first area 20 with roller compacted concrete paving, paving a second area 30 with roller compacted concrete paving adjacent to the first paved area 20, forming a cold joint 40 between the first area 20 and the second area 30, rolling the cold joint 40, allowing the rolled cold joint 40 to cure, milling the cold joint 40 and removing any milled material, applying primer 50 to the milled cold joint 40, filling the milled cold joint with hot poured filler 60 and finishing the filled cold joint 40. Use of this sealing method is illustrated in FIG. 1.

The RCC paving is a durable type of paving that is developed as a fast, economical construction method for dams, off-highway pavement projects, heavy-duty parking and storage areas and as a base for conventional asphalt pavement. RCC uses a stiff, zero-slump concrete mixture with the consistency of damp gravel, made up of local aggregates, crushed recycled concrete, portland cement and water. The mixture is placed and roller compacted with the same commonly available equipment used for asphalt pavement construction. This paving process requires no forms, finishing, or surface texturing.

RCC has a low water content, requiring it to be mixed in a pugmill mixer or central mix plant, instead of a ready mixed concrete truck. A dump truck transports freshly mixed RCC to the construction site where workers place the mixture using a high density asphalt spreader. Because of its low water-cement ratio, RCC typically has high strengths similar to, or even greater than, conventional concrete. RCC's high-strength properties, combined with its ease of construction and a high rate of production, often make RCC more economical than a flexible pavement. RCC pavement resists rutting, will not deform under heavy concentrated loads, does not deteriorate from spills of fuels and hydraulic fluids and will not soften under high temperatures. RCC paving requires a sealing method used to seal joints from adjacent sections from this type of paving. This sealing method is discussed throughout this application.

The first step of this sealing method 10 is to pave a first area 20 using roller compact concrete paving. Dump trucks transport the roller compact concrete and discharge it into traditional asphalt paving equipment, which in this case involves a high density double tamping bar asphalt paver (not shown). Typically the concrete is blended in continuous-mixing pugmills at or near the construction site. These high-output pugmills have the mixing efficiency needed to evenly disperse the relatively small amount of water used in this type of concrete processing. Once mixed, the high density double tamping bar asphalt pavers place the concrete material in layers up to 10 inches thick and as wide as 42 feet in width. These pugmills and high density double tamping bar asphalt pavers are the best mode for mixing and placing roller compacted concrete paving. Once placed, the concrete immediately undergoes compaction and the rollers continue to provide the needed proper density, strength, smoothness and surface texture. The concrete is then cured to harden the concrete and make it stronger. A spray-on membrane is used to seal moisture within the concrete.

The second step of the sealing method 10 is to pave a second area 30 with roller compacted concrete adjacent to the first area 20, thereby forming a seam or cold joint 40 between the first paved area 20 and the second paved area 30. The second asphalt area 30 is paved, rolled and cured with the same type of roller compacted concrete as the first area 20. Using this method 10, adjacent areas being paved shall be placed with unlimited time restrictions of any previously paved areas. The placement of the rolled compacted concrete must be done on a subgrade that is clean, free of foreign material, ponded water or frost. During hot weather or windy conditions, special precautions should be taken to minimize moisture loss due to evaporation. A water spray may be required, since the surface of the newly placed rolled compacted concrete should be kept moist during rolling and finishing operations.

Figure 2:
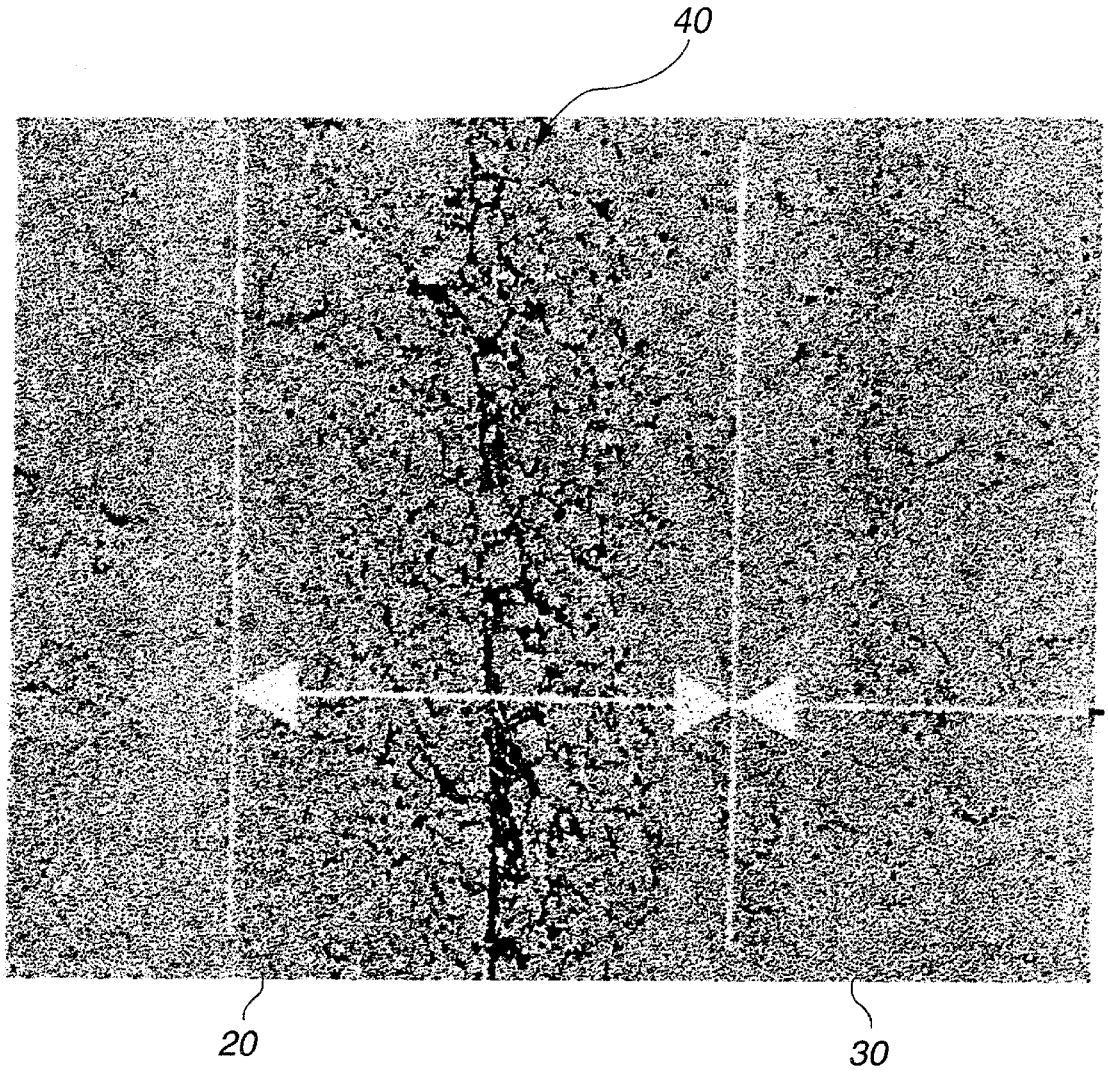
FIG. 2 is an overhead perspective view of a spalling roller compacted concrete joint.
Figure 3:
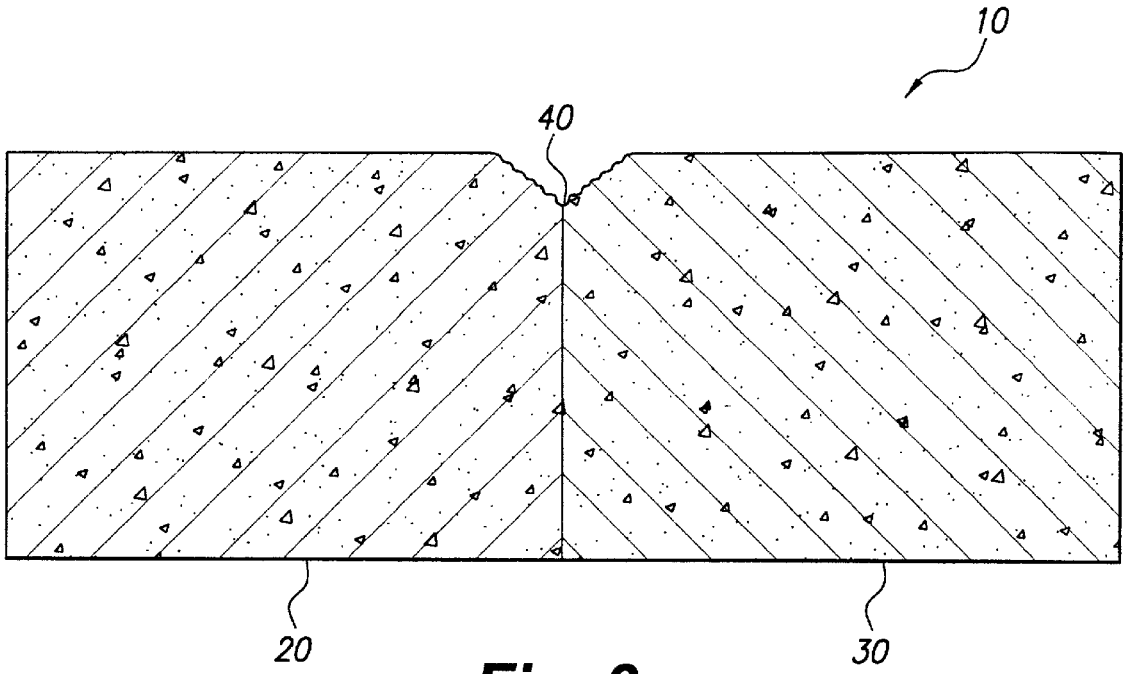
FIG. 3 is a cross-sectional side perspective view of a spalling roller compacted concrete joint.

Once the first area 20 and the second area 30 have been paved, the third step of the sealing method 10 is performed, which involves rolling the formed cold joint 40. The best mode to do this is with a tandem type dual steel asphalt roller (not shown) or a combination type rubber tired/steel drum asphalt roller (not shown). Rubber coated drum rollers are also used for this purpose. These rollers are self-propelled steel drum vibratory rollers having a minimum static weight of 10 tons (20,000 lbs.). The rollers are required for final compaction and removing roller marks. Walk behind vibratory rollers or plate tampers (not shown) can also be used for rolling areas that are inaccessible to large rollers. A close-up view of the formed joint 40 is shown on FIG. 2 and a cross-sectional side view of the formed cold joint 40 is shown on FIG. 3.

The next step of the sealing method 10 is allowing the rolled cold joint 40 to cure. A white pigmented curing compound is used to ensure a uniform void-free membrane across the entire roller compacted concrete pavement surface. This is the same curing compound that is used on the first area 20 and the second area 30. This and any other curing compound used must conform to ASTM-C-309.

After the cold joint 40 is cured, the cold joint 40 must be milled to eliminate the process of spalling within the cold joint. Spalling is the biggest problem with roller compacted concrete, since it results in the flaking and delamination of the formed joints. This can be caused from the expansion and contraction of the roller compacted concrete from weather and environmental conditions, as well as from heavy loads. Spalling can also result in penetration of moisture into the subgrade, which can also cause structural damage.

Figure 4:
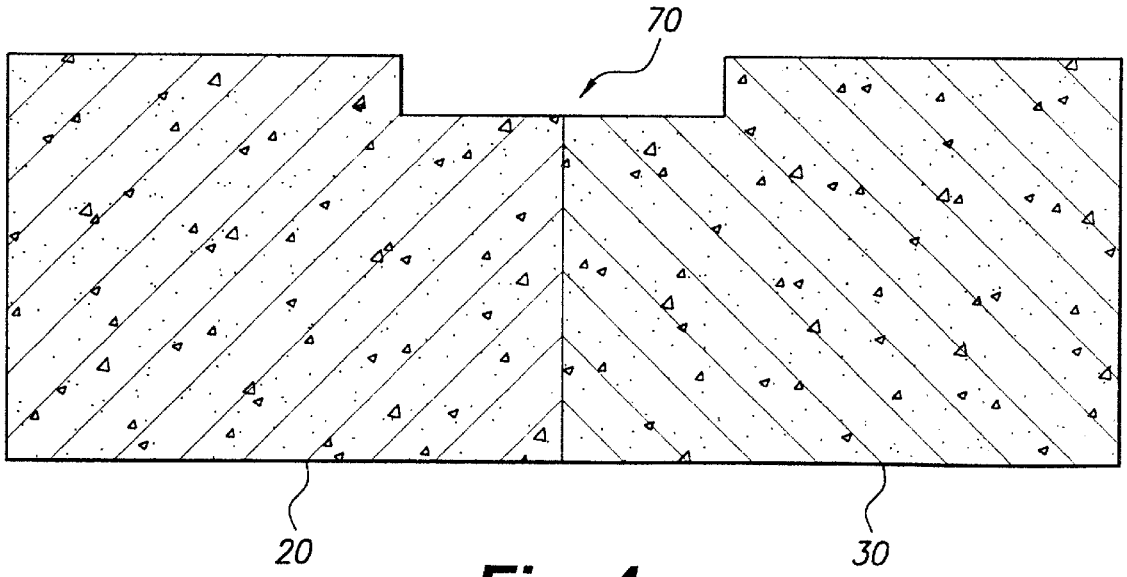
FIG. 4 is a cross-sectional side perspective view of a milled spalling roller compacted concrete joint.

To address the problem of spalling, the cold joint 40 is actually milled out with a milling machine or a concrete saw, with the removal of any old or "dead material". Typically, an area that gets spalled is approximately 0.50"–0.75" deep and 3"–4" wide and is done with a milling machine designed for removing rolled compacted concrete. Such a machine used is an ECON ROTO-PIC®, which is currently the best mode used for roller compacted concrete milling. The ECON ROTO-PIC®, with a specially modified cutting head, is a self-propelled machine, that is used to mill the entire length of the cold joint 40. An example of a spalled cold joint 70 is shown on FIG. 4.

Once the "spalled" joint 70 is milled, the next step in the method 10 requires that the spalled joint 70 is cleaned and blown out with compressed air. Saw cutting of perpendicular contraction joints (not shown) are done approximately every 40'–50' interval along the spalled joint 70 to eliminate random traverse cracks on the concrete pavement. This can be best done with a softcut paving saw by hand and filling the perpendicular traverse cuts with an appropriate sealant.

Figure 5:
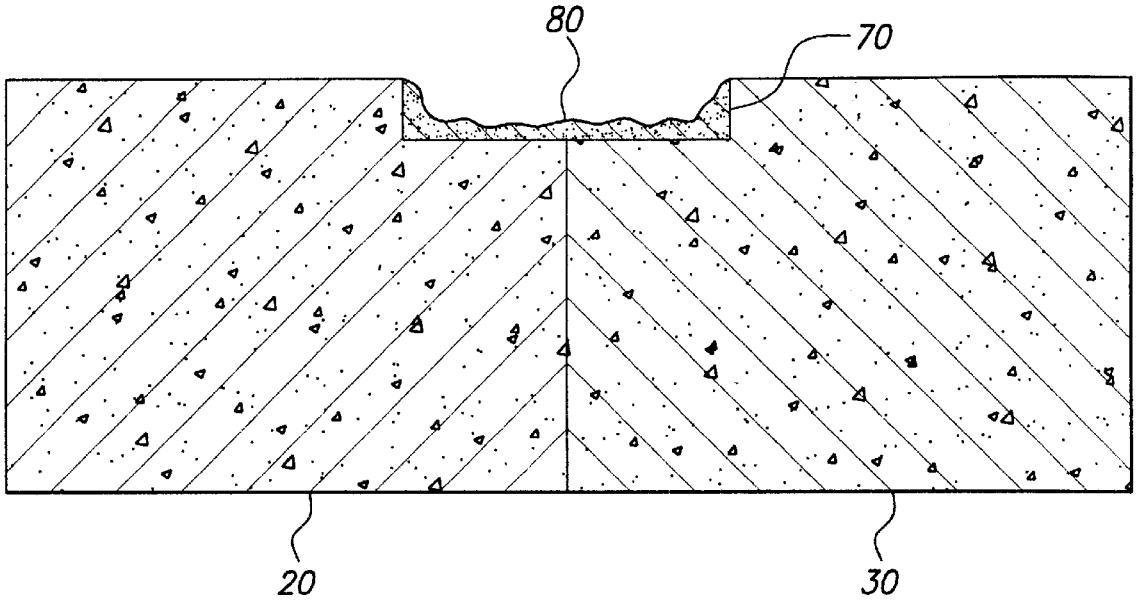
FIG. 5 is a cross-sectional side perspective view of a milled spalling roller compacted concrete joint after primer has been applied.

Once milled and cleaned, the next step of the method 10 is to coat the spalled cold joint 70 with a primer 80 that will help seal the spalled cold joint 70. This is illustrated in FIG. 5. After applying the primer 80, a hot poured filler 90 is applied to fill the remainder of the spalled cold joint 70. The hot poured filler 90 is a synthetic polymer modified resin containing fillers, sand and graded granite aggregates, which is called Fibre-Crete. Fibre-Crete is heated with a polymer aggregate double jacketed boiling pot (not shown) and applied directly to the primed spalled cold joint 70, filling the spalled cold joint 70. The Fibre-Crete is able to move with any expansion or contraction that might take place with the layers of concrete and at the same time, withstand any heavy loads and provide water-proof protection for the joints and subgrade.

Figure 6:
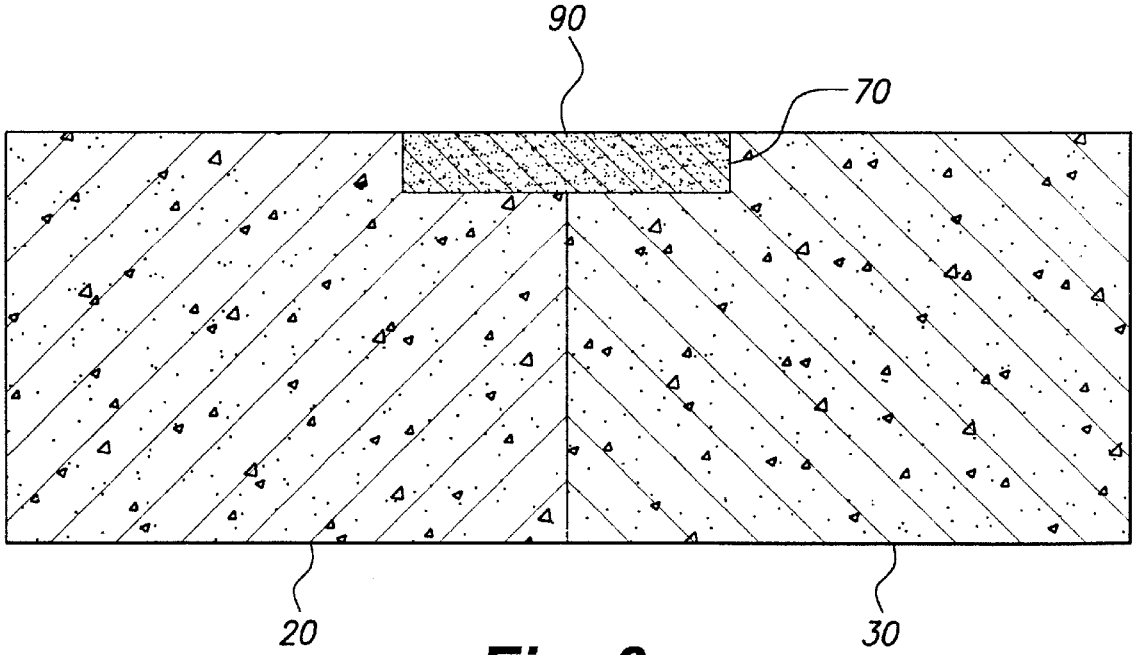
FIG. 6 is a cross-sectional side perspective view of a spalling roller compacted concrete joint after treatment.
Figure 7:
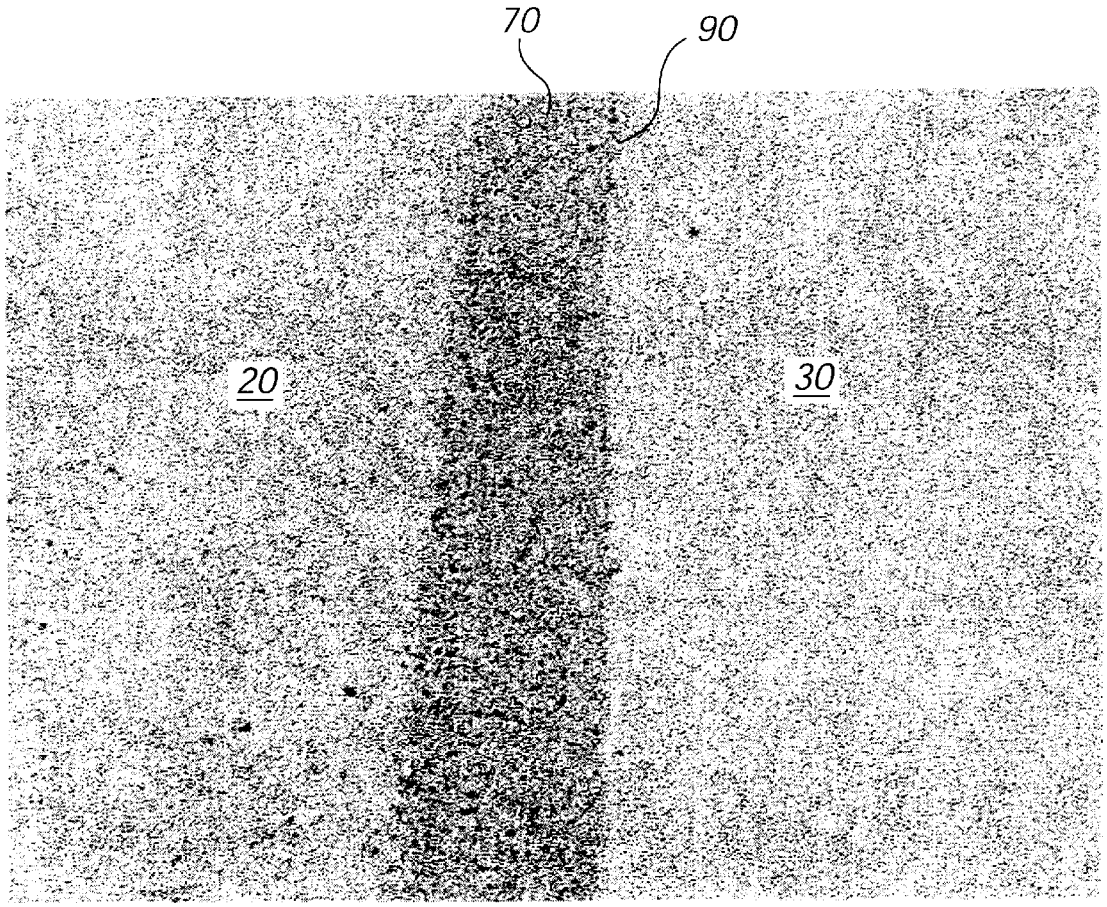
FIG. 7 is an overhead perspective view of a spalling roller compacted concrete joint after treatment.

The last step of the overall method 10 is finishing the filled cold joint, as is shown in FIG. 6 and FIG. 7. This involves allowing the filled cold joint to be air-dried and scraped with a hot concrete scraper (not shown). Typically it takes 30 minutes for the hot poured filler 90 to air-dry.

It is to be understood that the present invention is not limited to the embodiment described above, but encompasses any and all embodiments within the scope of the following claims.

I claim:

1. A roller compacted concrete paving sealing method comprising the steps of paving a first area with roller compacted concrete paving;

paving a second area with roller compacted concrete paving adjacent to the first paved area, forming a cold joint between the first area and the second area;

rolling the cold joint;

allowing the rolled cold joint to cure;

milling or sawing the cold joint and removing any milled material;

applying primer to the milled cold joint;

filling the milled joint with hot or cold poured filler; and finishing the filled joint.

2. The method according to claim 1, wherein said paving is done with a high density double tamping bar asphalt paver.

3. The method according to claim 1, wherein adjacent paved areas shall be placed without time restrictions to any previously paved areas.

4. The method according to claim 1, wherein said rolling is done with a tandem type dual steel drum asphalt roller.

5. The method according to claim 1, wherein said rolling is done with a combination type roller with pneumatic tires and steel coated drums.

6. The method according to claim 1, wherein said rolling is done with a combination type roller with rubber coated drums.

7. The method according to claim 1, wherein a white pigmented curing compound and water are applied.

8. The method according to claim 1, wherein joints are thoroughly cleaned and blown out with compressed air after milling.

9. The method according to claim 1, wherein transverse contraction cuts are performed at regular intervals along the milled joint.

10. The method according to claim 8, wherein transverse contraction cuts are filled with an expansive sealant.

11. The method according to claim 1, wherein the formed joint is milled with a milling machine with a specially modified cutting head or a concrete saw.

12. The method according to claim 1, wherein the hot poured filler is a synthetic polymer modified resin containing fillers, sand and graded granite aggregates.

13. The method according to claim 1, said hot poured filler is heated with a polymer aggregate double jacketed boiling pot.

14. The method according to claim 1, wherein finishing is allowing the joint to be air-dried and scraped with a hot concrete scraper.

* * * * *